US008101558B2

(12) United States Patent
Elvidge et al.

(10) Patent No.: US 8,101,558 B2
(45) Date of Patent: Jan. 24, 2012

(54) LUBRICATING OIL COMPOSITIONS

(75) Inventors: Benjamin R. Elvidge, Oxford (GB); Aleka Hinni, Oxford (GB); Jonathan Dilworth, Oxford (GB)

(73) Assignee: Infineum International Limited (GB)

( * ) Notice: Subject to any disclaimer, the term of this patent is extended or adjusted under 35 U.S.C. 154(b) by 311 days.

(21) Appl. No.: 12/628,249

(22) Filed: Dec. 1, 2009

(65) Prior Publication Data

US 2010/0242887 A1 Sep. 30, 2010

(30) Foreign Application Priority Data

Mar. 27, 2009 (EP) ..... 09156545

(51) Int. Cl.
*C10M 159/18* (2006.01)

(52) U.S. Cl. ..... 508/362; 508/184; 508/363; 508/369; 508/370; 508/379; 556/57

(58) Field of Classification Search ..... 508/184, 508/362, 363, 369, 370, 379; 556/57
See application file for complete search history.

(56) References Cited

U.S. PATENT DOCUMENTS

2006/0116298 A1 * 6/2006 Chambard et al. ..... 508/287

FOREIGN PATENT DOCUMENTS

WO WO 2008/113814 A1 9/2008

* cited by examiner

*Primary Examiner* — Walter D Griffin
*Assistant Examiner* — Taiwo Oladapo

(57) ABSTRACT

A composition containing an oil of lubricating viscosity in a concentrate-forming or major amount; and, as an additive component, an oil-soluble or oil dispersible mononuclear molybdenum compound having a molybdenum atom having bonded thereto one or more diazenide ligands and one or more hydrocarbyl group-carrying ligands, other than diazenide ligands, the hydrocarbyl groups conferring oil-solubility or oil-dispersibility on the molybdenum compound.

14 Claims, No Drawings

LUBRICATING OIL COMPOSITIONS

FIELD OF THE INVENTION

This invention relates to automotive lubricating oil compositions, more especially to compositions suitable for use in piston engine, especially gasoline (spark-ignited) and diesel (compression-ignited), crankcase lubrication, such compositions being referred to as crankcase lubricants; and to use of additives in friction modification and/or antioxidancy. The invention also concerns use of molybdenum-based additives as friction modifiers and/or antioxidants in automotive lubrication.

BACKGROUND OF THE INVENTION

A crankcase lubricant is an oil used for general lubrication in an engine where an oil sump is situated below the crankshaft of the engine and to which circulated oil returns. It is well known to include additives in crankcase lubricants for several purposes. Friction modifiers, also referred to as friction-reducing agents, may be boundary additives that operate by lowering friction coefficient and hence improve fuel economy.

Examples of friction modifiers are inorganic friction modifiers in the form of oil-soluble molybdenum compounds, which have been and are used commercially.

Such molybdenum compounds may, for example, be mononuclear, dinuclear or trinuclear according to the number of molybdenum atoms in the molecules of the compounds. The art describes mononuclear molybdenum compounds (sometimes referred to as complexes) and their use in lubricating oil compositions. For example, reference may be made to U.S. Pat. Nos. 4,588,829; 4,889,647; WO-A-2008/092944; WO-A-2008/092945; and WO-A-2008/113814 ('814). All but one of these references describe mononuclear molybdenum compounds where the molybdenum has an oxidation state of greater than +4; '814 is the exception in describing mononuclear molybdenum compounds where the molybdenum has an oxidation state of +4.

'814's molybdenum compounds have the potential energetic advantage of bearing molybdenum in the same oxidation state as $MoS_2$, which is believed to be the species, derived from the complex in use, responsible for the observed beneficial properties of molybdenum complexes in lubricating oil compositions. However, '814's molybdenum compounds contain eight atoms of sulfur per molecule, as seen in General Formula (1) in '814. Modern requirements are to reduce sulfur levels in lubricating oil compositions.

SUMMARY OF THE INVENTION

This invention meets the above-mentioned problem by employing one or more sulfur-free ligands in mononuclear molybdenum complexes, namely diazenides. Diazenides have not hitherto been reported as ligands in lubricating oil additives. It is also found that diazenide ligands may be tailored in the sense of varying their substitution to control performance properties.

In a first aspect, the invention is a composition comprising an oil of lubricating viscosity and, as an additive, an oil-soluble or oil-dispersible mononuclear molybdenum compound comprising molybdenum, and bonded thereto, one or more diazenide ligands and one or more hydrocarbyl group-carrying ligands, other than diazenide ligands, the hydrocarbyl group(s) conferring oil-solubility or oil-dispersibility properties on the molybdenum compound.

In a second aspect, the invention is the use of the molybdenum compound to confer friction reduction and/or antioxidancy properties on a lubricating oil composition.

In a third aspect, the invention is a method of lubricating an internal combustion engine comprising operating the engine and treating moving parts thereof with the lubricating oil composition.

In this specification, the following words and expressions, if and when used, have the meanings ascribed below, unless otherwise stated:

- "active ingredient" or "(a.i.)" refers to additive material that is not diluent or solvent;
- "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;
- "hydrocarbyl" means a chemical group of a compound that contains hydrogen and carbon atoms and that is bonded to the remainder of the compound directly via a carbon atom. The group may contain one or more atoms other than carbon and hydrogen ("hetero atoms") provided they do not affect the essentially hydrocarbyl nature of the group;
- "major amount" means in excess of 50 mass % of a composition;
- "minor amount" means less than 50 mass % of a composition;
- phosphorus content is measured by ASTM D5185; and
- molybdenum content is measured by ASTM D5185.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Oil of Lubricating Viscosity

The oil of lubricating viscosity (sometimes referred to as "base stock" or "base oil") is the primary liquid constituent of a lubricant, into which additives and possibly other oils are blended, for example to produce a final lubricant (or lubricant composition).

A base oil is useful for making concentrates as well as for making lubricating oil compositions therefrom, and may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have already been used in service. Such re-refined oils are also known as reclaimed or reprocessed oils and are often additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups I to V according to the API EOLCS 1509 definition.

When the oil of lubricating viscosity is used to make a concentrate, it is present in a concentrate-forming amount (e.g., from 30 to 70, such as 40 to 60, mass %) to give a concentrate containing for example 1 to 90, such as 10 to 80, preferably 20 to 80, more preferably 20 to 70, mass % active ingredient of the additive, optionally with one or more co-additives. The oil of lubricating viscosity used in a concentrate is a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons, are examples of suitable carrier fluids for concentrates.

Concentrates constitute a convenient means of handling additives before their use, as well as facilitating solution or dispersion of additives in lubricating oil compositions. When preparing a lubricating oil composition that contains more than one type of additive (sometime referred to as "additive components"), each additive may be incorporated separately, each in the form of a concentrate. In many instances, however, it is convenient to provide a so-called additive "package" (also referred to as an "adpack") comprising one or more co-additives, such as described hereinafter, in a single concentrate.

In the present invention, the oil of lubricating viscosity may be provided in a major amount in combination with a minor amount of the molybdenum compound and, if necessary, one or more co-additives, such as described hereinafter, constituting a lubricating oil composition. This preparation may be accomplished by adding the additive directly to the oil or by adding it in the form of a concentrate thereof to disperse or dissolve the additive. Additives may be added to the oil by any method known to those skilled in the art, either before, at the same time as, or after addition of other additives.

The terms "oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may permit incorporation of higher levels of a particular additive, if desired.

The lubricating oil compositions of the invention may be used to lubricate mechanical engine components, particularly in internal combustion engines, e.g. spark-ignited or compression-ignited two- or four-stroke reciprocating engines, by adding the composition thereto. Preferably, they are crankcase lubricants.

The lubricating oil compositions of the invention (and also concentrates) comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

When the invention is a lubricating oil composition comprising a major amount of an oil of lubricating viscosity, the composition may have low levels of one or more of sulfated ash, phosphorus or sulfur. Thus, the composition may, for example, contain up to 1.2, preferably up to 1.0, mass % of sulfated ash, based on the total mass of the composition. It may, for example, contain up to 0.1, preferably up to 0.08, more preferably up to 0.06, mass % of phosphorus, expressed as atoms of phosphorus, based on the total mass of the composition. It may, for example, contain up to 0.4, preferably up to 0.2, mass % of sulfur expressed as atoms of sulfur, based on the total mass of the composition.

Mononuclear Molybdenum Compounds

Preferably, the molybdenum is in the +4 oxidation state, though the presence of molybdenum in other oxidation states such as +5 and +6 is not precluded when the molybdenum is in the +4 oxidation state.

The or each diazenide ligand of the compound may have the formula —N═N—$R^3$ where $R^3$ is a substituent that contains atoms selected from C, H, N, O and halogen. $R^3$ may be a hydrocarbyl group, such as alkyl, containing 1 to 30 carbon atoms, preferably methyl. Also, $R^3$ may be a phenyl group or a benzoyl group, each of which may be optionally substituted with one or more hydrocarbyl groups or with substituents that contain atoms selected from C, H, N, O and halogen. As examples of such substituents, which may for example be para substituents, there may be mentioned alkoxy groups, such as methoxy, and trifluoromethyl.

As other examples of $R^3$, there may be mentioned naphthoyl (e.g. 2-naphthoyl) and quinolyl (e.g. 2-quinolyl), which may optionally be substituted with substituents such as mentioned above.

The, or each, ligand other than a diazenide ligand may be independently selected from the group of

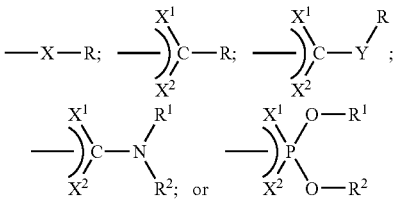

and mixtures thereof, wherein X, $X^1$, $X^2$, and Y are independently selected from the group of oxygen and sulfur, and wherein $R^1$, $R^2$, and R are independently selected from hydrogen and organo groups that may be the same or different. Preferably the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

"Hydrocarbyl" substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well a cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso and sulfoxy).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group generally range between 1 to 100, preferably from 1 to 30, and more preferably between 4 to 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands. Those skilled in the art will realize that formation of the compounds of the present invention requires selection of ligands having the appropriate charge to balance the molybdenum charge.

The mononuclear molybdenum compounds may, for example, be represented by the general formula $$Mo(Q)_m(L)_n$$

where

Q is the diazenide ligand;

m is 1, 2 or 3;

L is the ligand other than a diazenide ligand, preferably dithiocarbamate;

n is 1, 2, or 3; and m+n is 4

Preferably, m is 1 and n is 3. The compounds may be in the form of mixtures.

Conveniently, mononuclear Mo(IV) diazenide compounds of the invention may be made by causing a molybdenum (VI) salt such as $MoO_2(acac)_2$ to react with an appropriate salt of the other ligand(s) and with hydrazine or a substituted hydrazine, such as in methanol under reflux. "acac" is acetylacetonate.

The molybdenum compounds may be present in a lubricating oil composition at a concentration in the range 0.1 to 2 mass %, or providing at least 10, such as 50 to 2,000, ppm by mass of molybdenum atoms.

Preferably, the molybdenum from the molybdenum compound provides from 10 to 1500, such as 20 to 1000, more preferably 30 to 750, ppm by mass of molybdenum atoms based on the total mass of the lubricating oil composition. For some applications, the molybdenum may be present in an amount of greater than 500 ppm.

Co-Additives

Co-additives, with representative effective amounts, that may also be present, different from the molybdenum compound, are listed below. All the values listed are stated as mass percent active ingredient.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier[(1)] | 0-6 | 0.01-4 |
| Mineral or Synthetic Base Oil | Balance | Balance |

[(1)]Viscosity modifiers are used only in multi-graded oils.

The final lubricating oil composition, typically made by blending the or each additive into the base oil, may contain from 5 to 25, preferably 5 to 18, typically 7 to 15, mass % of the concentrate, the remainder being oil of lubricating viscosity.

The above mentioned co-additives are discussed in further detail as follows; as is known in the art, some additives can provide a multiplicity of effects, for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", that is non-metallic organic materials that form substantially no ash on combustion, in contrast to metal-containing, and hence ash-forming materials. Ashless dispersants comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025) fluorinated and oxylated. For example, boration may be accomplished by treating an acyl nitrogen-containing dispersant with a boron compound selected from boron oxide, boron halides, boron acids and esters of boron acids.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reacting an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN of 150 or greater, and typically of from 250 to 500 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g. sodium, potassium, lithium, calcium and magnesium. The most commonly-used metals are calcium and magnesium, which may both be present in detergents used in a lubricant, and mixtures of calcium and/or magnesium with sodium. Particularly convenient metal detergents are neutral and overbased calcium sulfonates and sulfurized phenates having a TBN of from 50 to 450.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically-hindered phenols, secondary aromatic amines, and organo-copper salts); hydroperoxide decomposers (e.g., organosulphur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulphur-containing antioxidants, aromatic amine-containing antioxidants, hindered phenolic antioxidants, dithiophosphates derivatives, metal thiocarbamates, and molybdenum-containing compounds.

Dihydrocarbyl dithiophosphate metals salts are frequently used as antiwear and antioxidant agents. The metal may be an alkali or alkaline earth metal, or aluminium, lead, tin, zinc, molybdenum, manganese, nickel or copper. Zinc salts are most commonly used in lubricating oil such as in amounts of 0.1 to 10, preferably 0.2 to 2, mass %, based upon the total mass of the lubricating oil compositions. They may be prepared in accordance with known techniques by first forming a dihydrocarbyl dithiophosphoric acid (DDPA), usually by reaction of one or more alcohols or a phenol with $P_2S_5$, and then neutralising the formed DDPA with a zinc compound. For example, a dithiophosphoric acid may be made by reaction with mixtures of primary and secondary alcohols. Alternatively, multiple dithiophosphoric acids can be prepared where the hydrocarbyl groups on one acid are entirely secondary and the hydrocarbyl groups on the other acids are entirely primary. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction.

Anti-wear agents reduce friction and excessive wear and are usually based on compounds containing sulphur or phosphorous or both, for example that are capable of depositing polysulfide films on the surfaces involved. Noteworthy are the dihydrocarbyl dithiophosphates, such as the zinc dialkyl dithiophosphates (ZDDP's) discussed herein.

Examples of ashless anti-wear agents include 1,2,3-triazoles, benzotriazoles, thiadiazoles, sulfurised fatty acid esters, and dithiocarbamate derivatives.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

Pour point depressants, otherwise known as lube oil flow improvers, lower the minimum temperature at which the oil will flow or can be poured. Such additives are well known. Typical of these additives are $C_8$ to $C_{18}$ dialkyl fumarate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricating oil. Viscosity modifiers that also function as dispersants are also known and may be prepared as described above for ashless dispersants. In general, dispersant viscosity modifiers are functionalised polymers (e.g. interpolymers of ethylene-propylene post-grafted with an active monomer such as maleic anhydride) which are then derivatised with, for example, an alcohol or amine.

The lubricant may be formulated with or without a conventional viscosity modifier and with or without a dispersant viscosity modifier, Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

EXAMPLES

The invention will now be particularly described in the following examples which are not intended to limit the scope of the claims hereof.

Preparations

Molybdenum complex compounds for use in the invention were synthesised as follows:

Preparation of Precursors

Preparation of Precursor Material $[MoO_2(acac)_2]$ (A)

$[(NH_4)_6][Mo_7O_{24}].4H_2O$ (5.00 g, 4.05 mmol) was dissolved in $H_2O$ (30 ml) and acetylacetone (6.65 mL, 64.70 mmol) was added dropwise. The pH was adjusted to 3.5 using 10% $HNO_3$ whereby a solid began to precipitate. After 1½ hours of vigorous stirring, the yellow $MoO_2(acac)_2$ (A) (acac=acetylacetonate) was isolated by filtration and washed with water. The product was recrystallized from a warm solution of 10% acetylacetone in ethanol (1.03 g, 3.16 mmol, 78%).

Preparation of Precursor Material $[MoO_2(Et_2dtc)_2]$ (B)

A solution of $Na[S_2CN(C_2H_5)_2].3H_2O$ (2.50 g, 11.10 mmol) in deionised water (50 mL) was slowly added to a solution of $[(NH_4)_6][Mo_7O_{24}].4H_2O$ (2.50 g, 2.02 mmol) in water (50 mL), with vigorous stirring. The pH was kept to about 2 by adding 1M $HNO_3$. The yellow precipitate formed was filtered and dried overnight between filter paper. The solid was recrystallized from 1:1 benzene:n-hexane as a bright yellow crystalline solid (B, 0.28 g, 0.66 mmol, 33%).

Preparation of Precursor Material Triethylammonium Dicocodithiocarbamate (C)

A caustic trap was set up comprising a 50% NaOH solution in water in order to trap any $H_2S$ gas formed during the reaction. Dicocoamine (42.44 g, 120.00 mmol) and $Net_3$ (7.94 mL, 62.70 mmol) where added to a 500 mL round bottom flask. Ethanol (100 mL) was added followed by the dropwise addition (over 15 min) of $CS_2$ (3.79 mL, 62.70 mmol) at 0° C. Cooling was maintained with stirring for 30 minutes and the reaction mixture was then warmed to ambient temperature and stirred for a further 1½ hours. The solvent was removed under reduced pressure to yield a first a pale yellow liquid and, after drying overnight under reduced pressure, a more viscous yellow substance 23.76 g, 43.00 mmol, 76%).

Synthesis of Molybdenum Complex Compounds

Synthesis of Molybdenum Complexes D-H; $[Mo(—N{=}NR^3)(S_2CNR^1R^2)_3]$ $R^1$, $R^2$ and $R^3$ are identified in the table below for each of D-H.

| | $R^3$ | $R^1$ and $R^2$ |
|---|---|---|
| D | 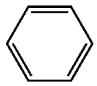 | coco |
| E | 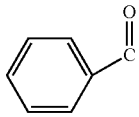 | coco |
| F | 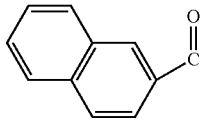 | coco |
| G | $CH_3$ | coco |
| H | 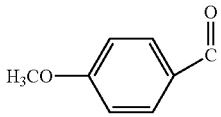 | coco |

General procedures for syntheses of D-H are listed below: quantities used, yields and descriptive data are displayed under the appropriate section for each compound.

General Procedure for Synthesis of Complexes D-F

Stage 1: A was stirred in methanol to which 2 equivalents of C were added. The contents were stirred at room temperature for 2 hours yielding the $[MoO_2(S_2CN(coco)_2)]$ intermediate.

Stage 2: To the reaction product of stage 1, an extra equivalent of C and a slight excess of the appropriate hydrazine were added. The mixture was refluxed for 70 minutes and then allowed to cool to room temperature. The solvent was decanted and the residue dissolved in dichloromethane and washed with water (3×40 mL).

Molybdenum(phenyldiazenide)tris(dicocodithiocarbamate) (D)

Stage 1: A (0.60 g, 1.84 mmol) and C (2.04 g, 3.68 mmol) in $CH_3OH$ (70 mL)

Stage 2: C (1.90 g, 1.84 mmol) and $C_6H_5NHNH_2$ (0.29 mL, 2.94 mmol) in $CH_3OH$ (30 mL)

An oil-soluble dark red viscous substance was isolated (2.21 g, 1.49 mmol, 80%)

Molybdenum(benzoyldiazenide)tris(dicocodithiocarbamate) (E)

Stage 1: A (0.30 g, 0.92 mmol) and C (1.02 g, 1.84 mmol) in $CH_3OH$ (50 mL)

Stage 2: C (0.95 g, 0.92 mmol) and $C_6H_5CONHNH_2$ (0.20 g, 1.47 mmol) in $CH_3OH$ (20 mL)

An oil-soluble dark red viscous substance was isolated (1.19 g, 0.78 mmol, 85%).

Molybdenum(2-naphthoyldiazenide)tris(dicocodithiocarbamate) (F)

Stage 1: A (0.50 g, 1.53 mmol) and C (1.70 g, 3.07 mmol) in $CH_3OH$ (60 mL)

Stage 2: C (0.85 g, 1.53 mmol) and $C_{10}H_7$-2-$CONHNH_2$ (0.40 g, 2.14 mmol) in $CH_3OH$ (20 mL)

A bright orange viscous oil-soluble substance was isolated (1.63 g, 1.04 mmol, 68%)

General Procedure for Synthesis of Complexes G-H

B was stirred in methanol to which 2 equivalents of C were added. The contents were stirred at room temperature for 2 hours yielding the $[MoO_2(S_2CN(coco)_2)]$ intermediate. To this, one equivalent of C and a slight excess of the appropriate hydrazine were added. The mixture was refluxed for 70 minutes and then allowed to cool to room temperature. The solvent was then decanted and the residue dissolved in dichloromethane, and extracted using water (3×40 mL).

Molybdenum(methyldiazenide)tris(dicocodithiocarbamate) (G)

Stage 1: B (0.50 g, 1.18 mmol) and C (1.30 g, 2.36 mmol) in $CH_3OH$ (60 mL)

Stage 2: C (0.65 g, 1.18 mmol) and $CH_3NHNH_2$ (0.07 mL, 1.42 mmol) in $CH_3OH$ (20 mL)

An oil-soluble brown viscous substance was isolated (1.46 g, 1.02 mmol, 87%)

Molybdenum(4-methoxylbenzoyldiazenide)tris(dicocodithiocarbamate) (H)

Stage 1: B (0.50 g, 1.18 mmol) and C (1.30 g, 2.36 mmol) in $CH_3OH$ (60 mL)

Stage 2: C (0.65 g, 1.18 mmol) and 4-OMe-$C_6H_4CONHNH_2$ (0.24 g, 1.42 mmol) in $CH_3OH$ (20 mL)

An oil-soluble orange viscous substance was isolated (1.26 g, 0.82 mmol, 69%)

Alternative Synthesis Method

An alternative synthesis for Molybdenum(phenyldiazenide)tris(dicocodithiocarbamate) (D):

$(NH_4)_6[Mo_7O_{24}].4H_2O$ (1.00 g, 0.81 mmol) was dissolved in methanol (20 ml) and acetylacetone (1.33 mL, 12.94 mmol) was added dropwise. The pH was adjusted to 3.5 using 10% $HNO_3$ whereupon a solid began to precipitate. After 1½ hours of vigorous stirring, 2 equivalents of C were added. After 2 hours of further stirring a further equivalent of C and an excess of phenylhydrazine were added. The mixture was refluxed for 70 minutes and then allowed to cool to room temperature. The solvent was then decanted and the residue was dissolved in dichloromethane and washed with water (3×40 mL).

Blending of Lubricating Oil Compositions

Each molybdenum compound, D-G, was blended into a fully-formulated lubricating oil composition at 230-280 ppm by mass of molybdenum, expressed as atoms of molybdenum. Each composition was identical other than in respect of the identity of the compound D-G. Each composition contained ingredients known in the art including base oil, viscosity modifier, pour-point depressant, dispersant, metal detergent, anti-oxidant and anti-wear additive.

Testing and Results

HFRR Tests

A high frequency reciprocating rig (HFRR), supplied by PCS Instruments, was used to evaluate the coefficient of friction of each of the above compositions. The test was carried out at 20 Hz, 400 g applied load, for 60 minutes at the temperature indicated below. A selection of the results is tabulated below where the values are coefficients of friction.

| Example Complex | Mo (ppm) | Temp (° C.) | Time (minutes) 1 | 25 | 40 |
|---|---|---|---|---|---|
| Reference | 0 | 140 | 0.141 | 0.156 | 0.154 |
| D | 270 | 140 | 0.159 | 0.138 | 0.124 |
| E | 280 | 140 | 0.145 | 0.094 | 0.085 |
| F | 230 | 120 | 0.158 | 0.117 | 0.114 |
| G | 270 | 120 | 0.153 | 0.065 | 0.058 |

Differential Scanning Calorimetry (DSC) Tests pDSC Results

The method requires a temperature increase at 40° C./min from 50° C. to 210° C. under an atmosphere of air (100 psi and zero flow) then held at that temperature for up to 2 h using an open Seiko Aluminium pan. This is a European standard method CECL-85-T-99. pDSC is recognized within the industry as a measure of the antioxidant potency of a lubricating composition.

For the reference, EEHC-45 (Exxon Hydrocracked) base oil alone was used.

For "D", 107.3 mg D was weighed into a 24 ml vial and 7.983 g EEHC-45 base oil added. The mixture was stirred at 60° C. for 1 hour in an oil bath to produce a dark brown solution.

For "E", 111.1 mg E was weighed into a 24 ml vial and 8.118 g EEHC-45 base oil added. The mixture was stirred at 60° C. for 1 hour in an oil bath to produce a dark orange solution.

| Example Complex | Mean Oxidative induction time (min) |
|---|---|
| Reference (zero molybdenum) | <2 |
| D | 4.1 |
| E | 4.5 |

The results demonstrate that the molybdenum complexes of the invention possess both friction reducing and anti-oxidancy properties in lubricating oil compositions. They also demonstrate that the results may, in some cases, be tailored by changing the substituent group on the diazenide ligand.

What is claimed is:

1. A composition comprising an oil of lubricating viscosity and, as an additive, an oil-soluble or oil-dispersible mononuclear molybdenum compound comprising molybdenum and bonded thereto, one or more diazenide ligands and one or more hydrocarbyl group-carrying ligands, other than diazenide ligands, the hydrocarbyl group(s) conferring oil-solubility or oil-dispersibility properties on the molybdenum compound.

2. A composition as claimed in claim 1 wherein the molybdenum is in the oxidation state +4.

3. A composition as claimed in claim 1 wherein the mononuclear molybdenum compound is represented by the general formula $$Mo(Q)_m(L)_n$$

where

Q is the diazenide ligand;

M is 1, 2 or 3;

L is the ligand other than diazenide;

n is 1, 2 or 3; and m+n is 4.

4. A composition as claimed in claim 1 wherein each, or the, diazenide ligand has the formula —N═N—$R^3$ where $R^3$ is a substituent that contains atoms selected from C, H, N, O and halogen.

5. A composition as claimed in claim 4 wherein $R^3$ is a methyl group.

6. A composition as claimed in claim 1 wherein each, or the, said different ligand has the formula:

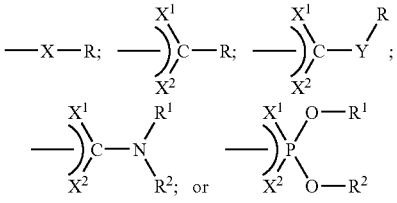

where each of X, $X^1$, $X^2$ and Y is independently oxygen or sulfur and each of R, $R^1$ and $R^2$ is independently a hydrogen atom or an organo group.

7. A composition as claimed in claim 6 wherein each, or the, said different ligand is independently dialkyldithiophosphate, thioxanthate, dialkylphosphate, dialkyldithiocarbamate, dialkylthiophosphate and xanthate, preferably dialkyldithiocarbamate.

8. A composition as claimed in claim 1 wherein the molybdenum compound comprises one diazenide ligand and three said other ligands.

9. A composition as claimed in claim 1 wherein the oil of lubricating viscosity is present in a concentrate-forming amount.

10. A composition as claimed in claim 1 wherein the oil of lubricating viscosity is present in a major amount whereby the composition is a lubricating oil composition.

11. A composition as claimed in claim 10 wherein the molybdenum composition provides the lubricating oil composition with 10 to 2000 ppm by mass of molybdenum atoms based on the weight of the composition.

12. A composition as claimed in claim 10 comprising one or more additives, different from the molybdenum compound, selected from dispersants, metal detergents, corrosion inhibitors, anti-oxidants, anti-wear agents, friction modifiers, antifoamants and viscosity modifiers.

13. A method of lubricating an internal combustion engine comprising operating the engine and treating moving parts thereof with a lubricating oil composition as claimed in claim 10.

14. A crankcase lubricating oil composition for conferring friction reduction and/or anti-oxidancy properties comprising an oil of lubricating viscosity in a major proportion and, as an additive, an oil-soluble or oil-dispersible mononuclear molybdenum compound comprising molybdenum and bonded thereto, one or more diazenide ligands and one or more hydrocarbyl group-carrying ligands, other than diazenide ligands, the hydrocarbyl group(s) conferring oil-solubility or oil-dispersibility properties on the molybdenum compound.

* * * * *